US008337773B2

(12) United States Patent
Berns et al.

(10) Patent No.: US 8,337,773 B2
(45) Date of Patent: Dec. 25, 2012

(54) ARTICLE WITH DEODORANT DEVICE

(75) Inventors: Jason A. Berns, Baltimore, MD (US); Stephen Cleary, Severna Park, MD (US); Michael Meyer, Baltimore, MD (US)

(73) Assignee: Under Armour, Inc., Baltimore, MD (US)

( * ) Notice: Subject to any disclaimer, the term of this patent is extended or adjusted under 35 U.S.C. 154(b) by 63 days.

(21) Appl. No.: 12/905,851

(22) Filed: Oct. 15, 2010

(65) Prior Publication Data

US 2012/0093685 A1 Apr. 19, 2012

(51) Int. Cl.

| | |
|---|---|
| ***A62B 7/08*** | (2006.01) |
| ***A61L 9/00*** | (2006.01) |
| ***A01M 13/00*** | (2006.01) |
| ***A24F 25/00*** | (2006.01) |
| ***B65D 85/18*** | (2006.01) |
| ***B65D 85/20*** | (2006.01) |

(52) U.S. Cl. ..... 422/306; 422/305; 43/1; 43/125; 261/DIG. 17; 239/34; 206/286; 206/315.1

(58) Field of Classification Search ..... 422/120, 422/123, 305–306; 43/1, 125; 261/DIG. 17; 239/34; 206/286, 315.1
See application file for complete search history.

(56) References Cited

U.S. PATENT DOCUMENTS

| | | | | |
|---|---|---|---|---|
| 2,143,062 | A | 5/1937 | Ericson et al. | |
| 2,545,160 | A | 4/1950 | Miller | |
| 2,802,590 | A | 11/1954 | Tupper | |
| 3,468,471 | A | 6/1966 | Linder | |
| 3,759,356 | A | 9/1973 | Bostick et al. | |
| 3,840,145 | A | 10/1974 | Almanza | |
| 3,902,877 | A | 9/1975 | Swaim | |
| 3,964,684 | A | 6/1976 | Schimanski | |
| 4,271,834 | A | 6/1981 | Tanaka | |
| 4,917,254 | A | 4/1990 | Ciriacks | |
| 5,065,886 | A | 11/1991 | Sher | |
| 5,174,462 | A | 12/1992 | Hames | |
| 5,539,930 | A | 7/1996 | Sesselmann | |
| 5,988,520 | A | 11/1999 | Bitner | |
| 6,134,806 | A * | 10/2000 | Dhaemers | 34/404 |
| 7,108,425 | B2 | 9/2006 | Temkin | |
| 7,210,426 | B2 | 5/2007 | Yeung | |
| 7,273,184 | B2 | 9/2007 | Brown et al. | |
| 2002/0062541 | A1 | 5/2002 | Fildan | |
| 2003/0064009 | A1 * | 4/2003 | Baaset | 422/123 |
| 2005/0199741 | A1 * | 9/2005 | Thomson | 239/36 |
| 2005/0278820 | A1 | 12/2005 | Newman | |
| 2006/0272980 | A1 | 12/2006 | Montgomery | |
| 2008/0118411 | A1 | 5/2008 | D'Arinzo | |

FOREIGN PATENT DOCUMENTS

| | | | |
|---|---|---|---|
| FR | 2775561 | A3 | 9/1999 |
| JP | 10042927 | A | 2/1998 |

* cited by examiner

*Primary Examiner* — Jill Warden
*Assistant Examiner* — Monzer Chorbaji
(74) *Attorney, Agent, or Firm* — Maginot Moore & Beck

(57) ABSTRACT

An article configured to be worn or carried by a human includes a body portion with a deodorant enclosure and a deodorant insert positioned within the deodorant enclosure. The body portion is comprised of a flexible material that defines an inside and an outside of the article. An opening is formed in the body portion which provides a passage between the inside and the outside of the article. The deodorant enclosure is secured to the body portion at the opening. The deodorant enclosure includes a chamber positioned between an air permeable inner wall and an air permeable outer wall. The deodorant insert is removably positioned within the chamber of the deodorant enclosure.

15 Claims, 5 Drawing Sheets

ARTICLE WITH DEODORANT DEVICE

FIELD

This application relates to the field of deodorant devices and particularly to deodorant devices for use with bags, garments or other apparel or accessories configured to be worn by or carried by a human.

BACKGROUND

Various devices are available for deodorizing articles that may be worn or carried by humans. For example, fragrances or odor neutralizers may be inserted into a gym bag in an attempt to reduce the odors associated with clothing that sits in the bag for some time following use of the clothing. These deodorizing products may be provided by a spray or solid product that is dropped into the gym bag. However, the deodorizing product may be easily covered by the fouled articles placed in the bag, thus reducing the effectiveness of the deodorizing product. Once covered by other articles, the deodorizing product is not active in the head space at the top of the bag. Odors in this space at the top of the bag tend to easily escape from the bag and offend the user of the bag.

In addition to use of deodorizing products in bags, deodorizing products are sometimes also used on garments at the time of wear. For example, hunters often wish to mask their human scent. This may be accomplished by applying a spray scent or an odor neutralizer to the clothing of the hunter. However, these deodorizing products are often considered an inconvenience to the hunter since they must be applied repeatedly over time and at least after each washing. In the interest of convenience for the user, some hunting garments have been developed with a permanent odor capture layer or finish that is applied to the surface of the garment. However, these products with permanent odor capture properties tend to wash out over time, leaving the user with a garment that does not have strong odor capture capabilities.

In view of the foregoing, it would be desirable to provide an improved deodorant device. It would be advantageous if such device could be fixedly incorporated on an article such as a garment, bag, or other article to be carried by a human. It would also be advantageous if the deodorant device could be used easily and effectively throughout the life of the garment. Furthermore, it would be advantageous if the deodorant device provided the user with various options for different deodorizing products to be used in association with the article.

SUMMARY

In accordance with one embodiment of the disclosure, there is provided an article configured to be worn or carried by a human, the article including a body portion with a deodorant enclosure and a deodorant insert positioned within the deodorant enclosure. The body portion of the article is comprised of a flexible material that defines an inside and an outside of the article. An opening is formed in the body portion which provides a passage between the inside and the outside of the article. The deodorant enclosure is secured to the body portion at the opening. The deodorant enclosure includes a chamber positioned between an inner wall and an outer wall. The deodorant insert is positioned within the chamber.

Various embodiments of the article are possible. For example, the article may be provided in the form of a garment or a bag where the body portion is a textile material. In one embodiment, the deodorant is a solid deodorant substance that is removably retained within the chamber. The deodorant enclosure may be configured to move between a closed position and an open position, wherein the deodorant insert is secured in the chamber when the deodorant enclosure is in the closed position, and the deodorant insert is removable from the chamber when the deodorant enclosure is in the open position. The inner wall and the outer wall of the deodorant enclosure may include a plurality of air passages that lead to the chamber. The inner wall of the deodorant enclosure may be attached to a frame member with a hinge structure.

In accordance with yet another embodiment of the disclosure, a deodorant device comprises a piece of textile with a hole formed in the piece of textile, and a deodorant enclosure secured to the piece of textile. The hole defines a passage from a first side of the piece of textile to a second side of the piece textile. The deodorant enclosure at least partially covers the hole and includes a chamber positioned between a first side of the deodorant enclosure and an opposing second side of the deodorant enclosure. Both the first side and the second side of the deodorant enclosure permeable to air. A deodorant insert is removably positioned in the chamber of the deodorant enclosure.

Pursuant to yet another embodiment of the disclosure, there is provided a method of managing odor in a textile article. The method comprises opening a deodorant enclosure positioned on the textile article in order to expose a chamber that is positioned between a first side and a second side of the deodorant enclosure. The first side of the deodorant enclosure is positioned on an outer side of the textile article, and the second side of the deodorant enclosure is positioned on an inner side of the textile article. Both the first side and the second side of the deodorant enclosure are permeable to air. The method further comprises removing a first deodorant insert from the chamber, inserting a second deodorant insert into the chamber, and closing the deodorant enclosure to secure the second deodorant insert in the chamber.

The above described features and advantages, as well as others, will become more readily apparent to those of ordinary skill in the art by reference to the following detailed description and accompanying drawings. While it would be desirable to provide an article to be worn or carried by a human that provides one or more of these or other advantageous features, the teachings disclosed herein extend to those embodiments which fall within the scope of the appended claims, regardless of whether they accomplish one or more of the above-mentioned advantages.

DESCRIPTION

Figure 1:
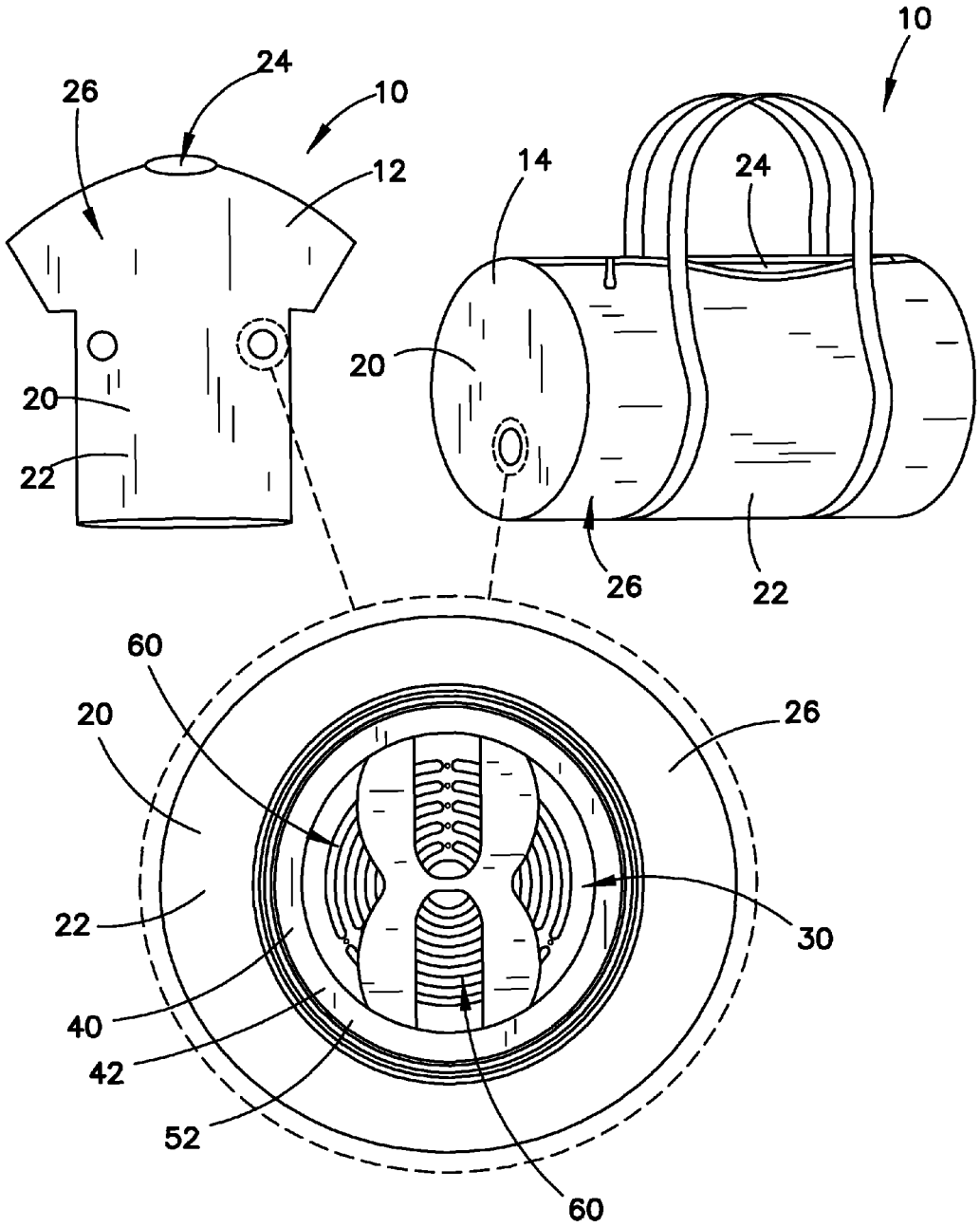
FIG. 1 shows a diagrammatic view of a deodorant device with a deodorant enclosure placed on a textile.
Figure 2:
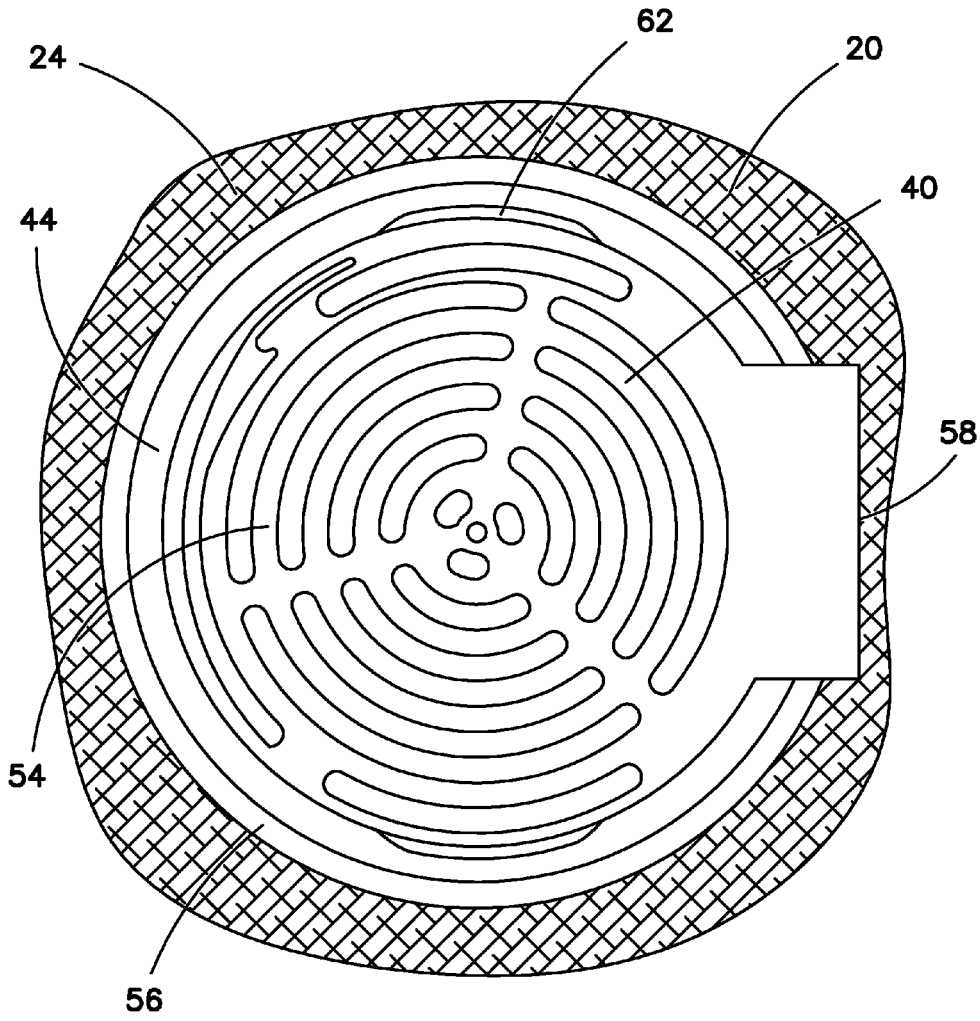
FIG. 2 shows a plan view of the inner wall of the deodorant enclosure of FIG. 1.
Figure 3:
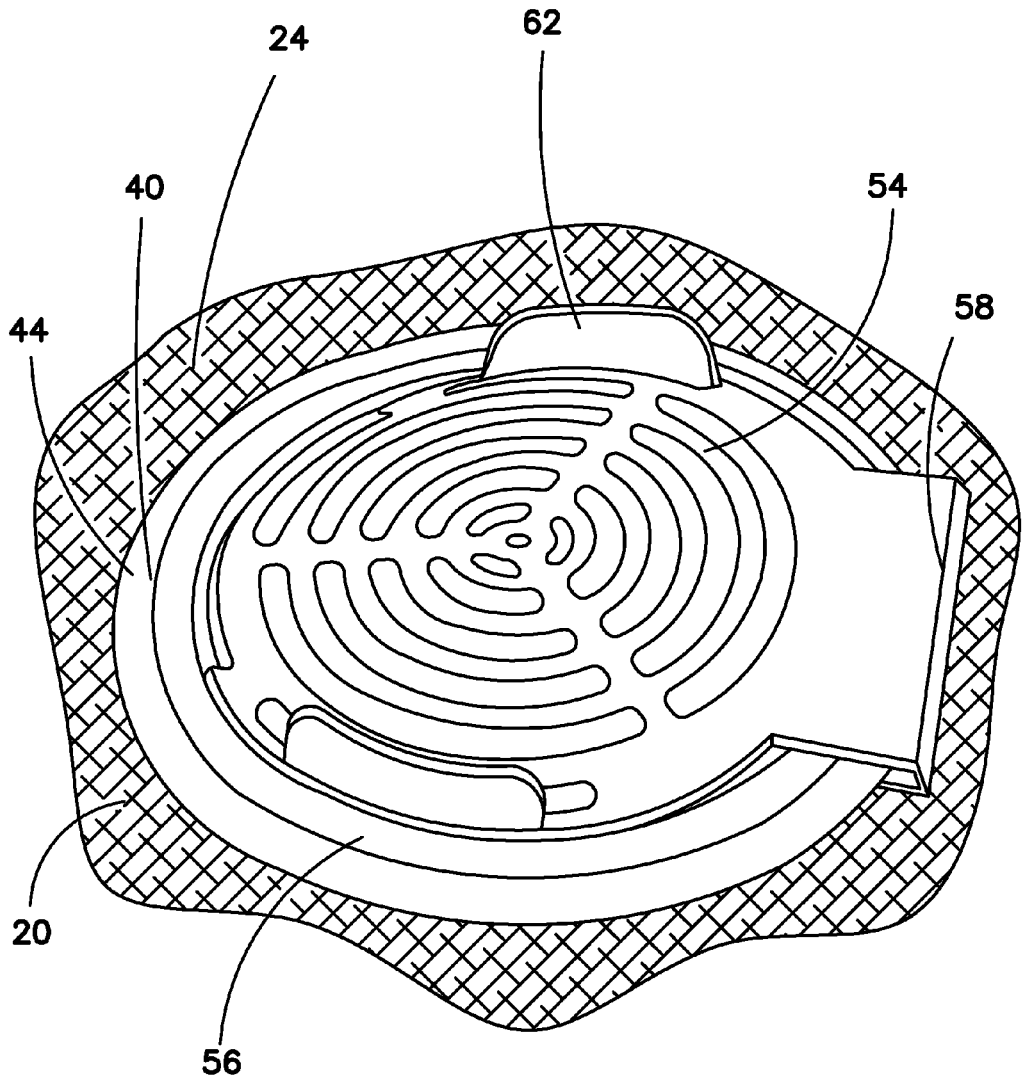
FIG. 3 shows a perspective view of the inner wall of the deodorant enclosure of FIG. 2.
Figure 4:
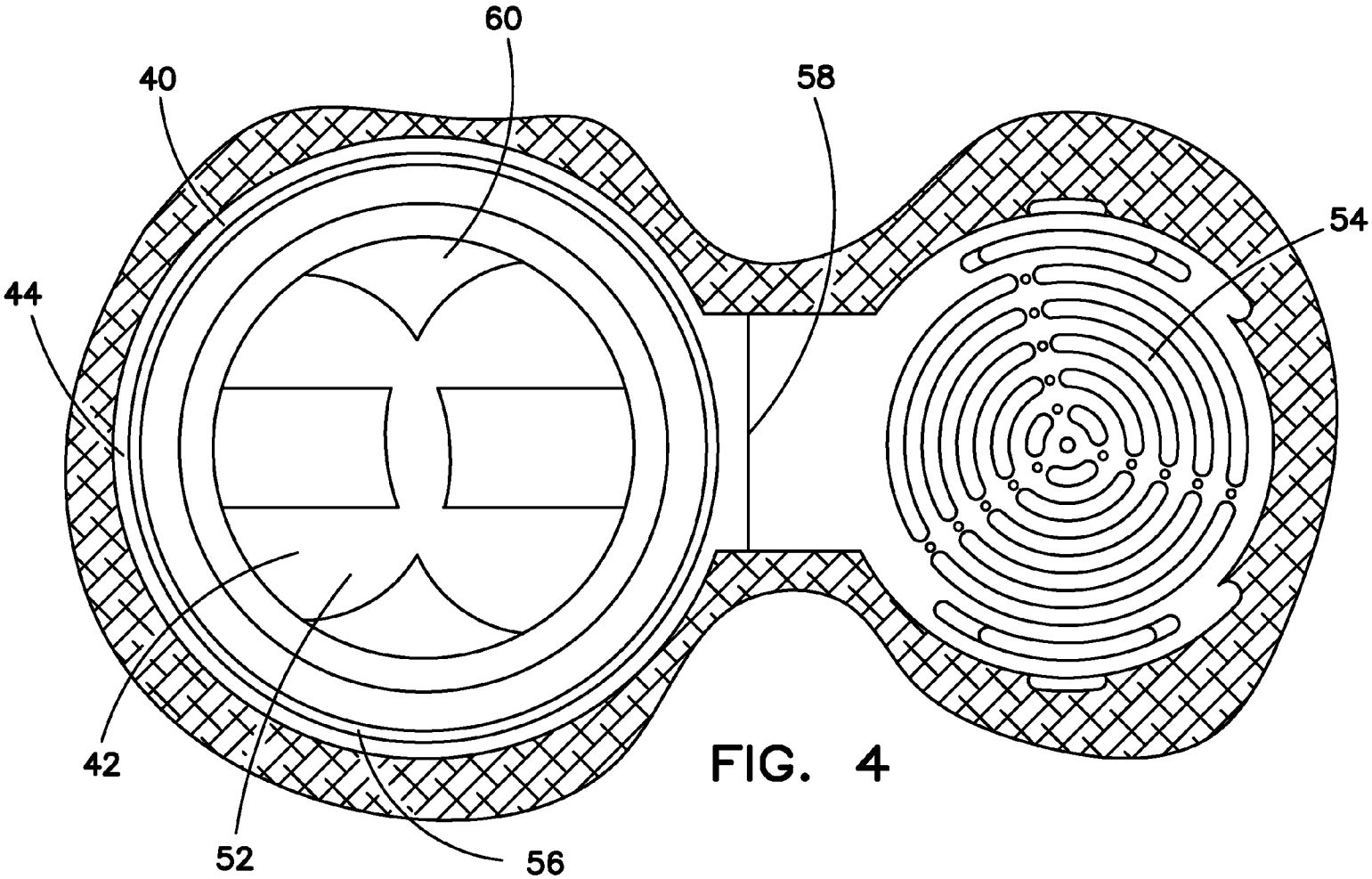
FIG. 4 shows a plan view of the deodorant enclosure of FIG. 2 with the inner wall in an open position.

With general reference to FIGS. 1-5, an article 10 to be worn or carried by a human is shown. Each article 10 includes a body portion 20 with a deodorant enclosure 40 that is carried by the body portion 20. The deodorant enclosure 40 includes an outer wall 52 and an inner wall 54 with a chamber 60 positioned between the outer wall 52 and the inner wall 54. As explained in further detail below, the chamber 60 is configured to receive a deodorant insert 70 (see FIG. 5). The term "deodorant" as used herein refers to a substance intended to neutralize, mask, or eliminate odor or otherwise provide a fragrance or scent. In at least one embodiment, a "deodorant" may include a substance intended to prevent the fermentation of bacteria or otherwise control bacteria. However, in one or more other embodiments, a "deodorant" may not include any bacteria control substance or qualities, and may merely refer to a substance intended to neutralize, mask, or eliminate odor or otherwise provide a fragrance or scent.

The article 10 may be provided in any number of different forms. Two exemplary forms of the article 10 are shown in FIG. 1. The first form is shown as a garment, and particularly a shirt 12. The second form is shown as a bag, and particularly a gym bag 14. While a shirt 12 and a bag 14 have been shown as exemplary embodiments of the article 10 in FIG. 1, it will be recognized that the article 10 may be provided in any number of different forms including, for example, a backpack, jacket, coat, shoe, hat, pants, or any other article configured to be worn or carried by a human.

The body portion 20 of the article 10 covers a main portion of the article 10 and is generally comprised of a flexible material 22. In the disclosed embodiment, the flexible material 22 is a textile material, such as, for example, a knit, woven, or non-woven fabric. In other embodiments, the flexible material 22 may be a leather material, synthetic leather material, or other flexible material. The body portion defines an outside inside 24 and an outside 26 of the article 10.

An opening 30 is formed in the body portion 20. The opening 30 provides a hole or passage in the body portion 20 that extends between the inside 24 and the outside 26 of the article 10. The opening 30 is generally sized slightly smaller than the deodorant enclosure 40 with the deodorant enclosure 40 completely covering the opening 30. However, in some embodiments, portions of the opening 30 may extend past the deodorant enclosure 40. In the disclosed embodiment, the opening 30 is formed in a single integral piece of flexible material 22. However, in other embodiments the opening may be formed in a piece of textile that is comprised of a first section joined to a second section with the opening 30 formed between the first section and the second section (e.g., along a seam).

The deodorant enclosure 40 is secured to the body portion 20 of the article 10 around the perimeter of the opening 30. In the disclosed embodiment of FIGS. 1-5, the deodorant enclosure 40 includes a first part 42 positioned around the perimeter of the opening 30 on the outside 26 of the body portion 20. The deodorant enclosure 40 also includes a second part 44 positioned around the perimeter of the opening 30 on the inside 24 of the of the body portion. The deodorant enclosure 40 provides a chamber positioned in the opening 30 between the first part 42 and the second part 44. The first part 42 and the second part 44 may be secured to the body portion in a number of different ways. For example, the first part 42 and the second part 44 may be coupled to the body portion using stitching, adhesives, welding, or any of various other methods as will be recognized by those of skill in the art.

Figure 5:
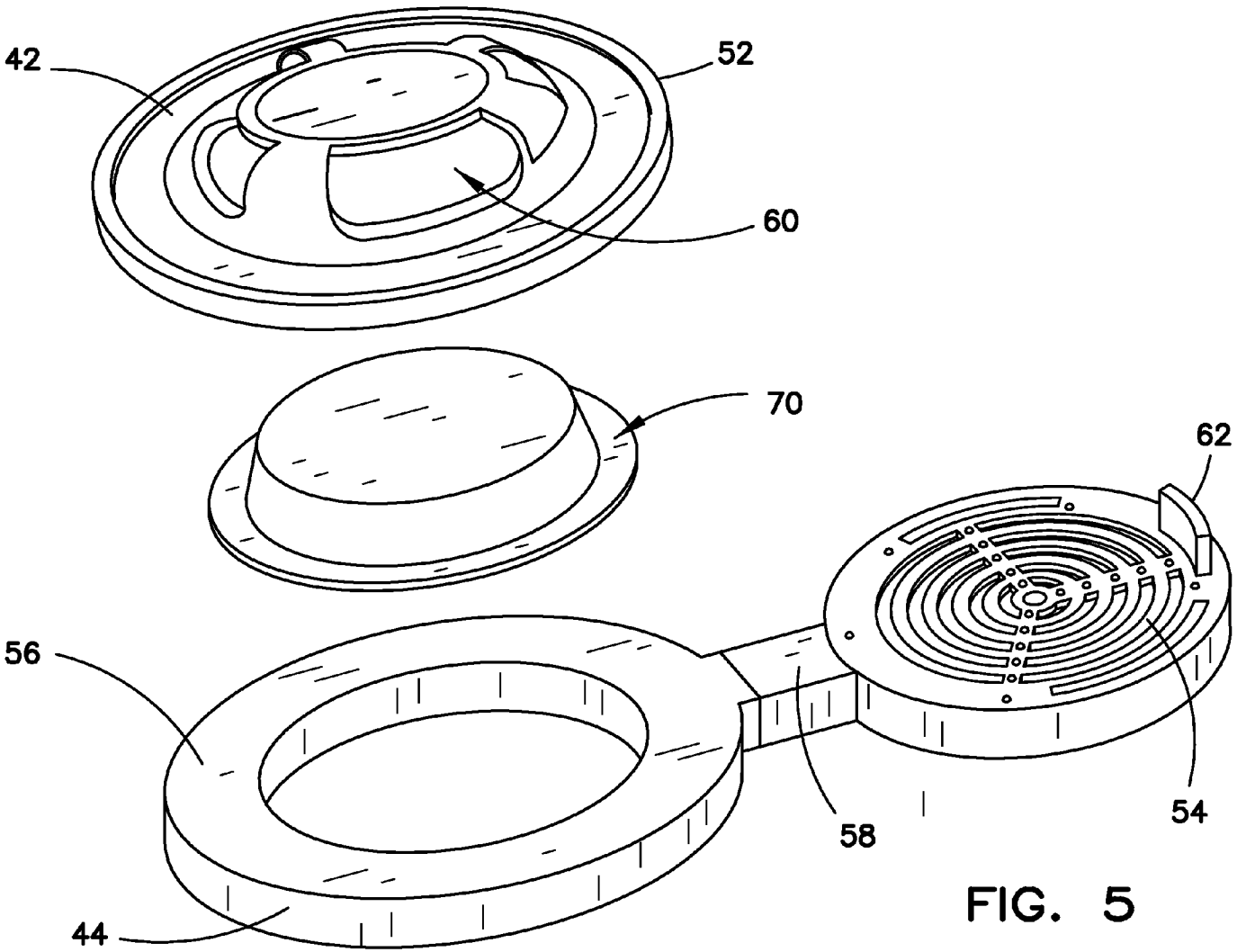
FIG. 5 shows an exploded perspective view of the deodorant enclosure of FIG. 1 with a deodorant insert.

As best shown in FIGS. 1 and 5, the first part 42 of the deodorant enclosure provides an outer wall 52 of the deodorant enclosure 40 with the chamber 60 positioned to the inside of the outer wall 52. In the disclosed embodiment, the outer wall 52 is disc shaped with a solid outer perimeter portion and an air permeable central portion. The central portion generally includes a plurality of support members with holes formed between the support members.

As best shown in FIGS. 2-5, the second part 44 of the deodorant enclosure includes an inner wall 54 surrounded by a peripheral frame 56. The inner wall 54 is connected to the peripheral frame 56 at a hinge structure 58. The hinge structure 58 allows the inner wall 54 to act as a door and pivot relative to the peripheral frame between a closed position (see FIGS. 2 and 3) and an open position (see FIG. 4). The chamber 60 is exposed to the inside of the article 10 when the inner wall 54 is in the open position, and the chamber 60 is separated from the inside of the article 10 by the inner wall 54 when the inner wall 54 is in the closed position. The inner wall includes one or more handles 62 that extend further inward from the inner wall 54. These handles 62 are provided to assist the user in opening the deodorant enclosure 40.

The peripheral frame 56 is generally solid and void of holes. In contrast, the inner wall 54 includes a plurality of air passages, making the inner wall 54 permeable to air. In the disclosed embodiment, the inner wall 54 is provided as a grill-like structure with a plurality of circumferential and radial support bars with slots in between the bars. Because both the inner wall 54 and the outer wall 52 include a plurality of holes, air can easily flow into and out of the chamber 60 of the deodorant enclosure 40. The holes in the inner wall 54 and the outer wall are significantly larger (e.g., by a factor of ten or more) than any micro-sized holes that may exist in the flexible material 22 that makes up the body portion 20. Accordingly, air more easily flows through the deodorant enclosure 40 than through the body portion 20.

The inner wall 54 engages the frame with an interference fit that allows the inner wall to lock in the closed position. Accordingly, when a user moves the inner wall 54 to the closed position, the user will feel a slight pop or other tactile feel indicating that the inner wall has seated against the frame. The hinge structure 58 is durable, allowing the inner wall 54 to be opened and closed repeatedly over the life of the deodorant enclosure 40.

With reference now to FIG. 5, a deodorant insert 70 is removably positioned in the chamber 60 of the deodorant enclosure 40. When the inner wall 54 is in the closed position, the deodorant insert 70 is secured in place within the chamber 60, being trapped between the outer wall 52 and the inner wall 54. When the inner wall 54 is in the open position, the deodorant insert 70 may be inserted into or removed from the chamber 60.

In the embodiment of FIG. 5, the deodorant insert 70 is provided as solid material in the form of a deodorant disc. The deodorant insert 70 is designed and dimensioned to fit within the chamber 60 of the deodorant enclosure. The deodorant insert 70 is small enough such that the inner wall 54 can move to the closed position with the deodorant insert 70 inside the chamber 60. The deodorant insert 70 is also large enough so that it will not fit through the holes in the outer wall 52 and inner wall 54 of the deodorant enclosure 40.

While the deodorant insert 70 has been disclosed in one embodiment as a solid material, in other embodiments, the deodorant insert may comprise a liquid substance. In embodiments where the deodorant is a liquid, a deodorant cartridge may be provided to retain the liquid within the chamber 60 of the deodorant enclosure 40. Those of skill in the art will recognize that the deodorant insert 70 may be comprised of any number of various deodorant compounds and substances, including, for example, those compounds and substances commonly used for household air fresheners or odor neutralizers (such as activated carbon), or some combination of such compounds and substances. The user may select from numerous different deodorant inserts having different characteristics, including different fragrances, different odor neutralizing qualities, different colors, etc. While deodorant inserts 70 of different sizes and shapes may be provided, each deodorant insert 70 will be configured to fit within the chamber 60 of the deodorant enclosure 40 without falling through the air holes in the deodorant enclosure 40.

In operation, the deodorant device disclosed above may be used to manage odor in the article. In particular, a user of the article can selectively input or remove the deodorant insert 70 from the chamber 60 of the deodorant enclosure 40 in order to provide odor management qualities on the article. Once a deodorant insert 70 is positioned in the chamber, it may lose its deodorizing potency over time and become spent. When the user determines that the deodorant insert 70 is spent, the user simply opens the deodorant enclosure 40 positioned on the article 10 in order to expose the chamber 60. The user then removes the spent deodorant insert 70 from the chamber 60 and inserts a new deodorant insert 70. The user then closes the deodorant enclosure 40 in order to secure the new deodorant insert 70 in the chamber 60. The new deodorant insert 70 will provide the user with a relatively long period of use. Advantageously, if the article 10 is to be washed by the user, the user may simply remove the deodorant insert 70 from the chamber 60 before washing the article 10, and then replace the deodorant insert 70 in the chamber 60 following the wash. The user may select from different deodorant inserts 70 to be placed in the deodorant enclosure, depending on the desired use of the article. For example, a user who will be hunting with the article 10 may choose to place a deodorant insert 70 with an animal scent in the chamber 60 of deodorant enclosure 40. However, in another non-hunting situation where the article will be used, the same user may select a deodorant insert 70 with a pleasant fragrance for insertion into the chamber 60 of the deodorant enclosure 40.

The foregoing detailed description of one or more embodiments of the article with deodorant device has been presented herein by way of example only and not limitation. It will be recognized that there are advantages to certain individual features and functions described herein that may be obtained without incorporating other features and functions described herein. Moreover, it will be recognized that various alternatives, modifications, variations, or improvements of the above-disclosed embodiments and other features and functions, or alternatives thereof, may be desirably combined into many other different embodiments, systems or applications. Presently unforeseen or unanticipated alternatives, modifications, variations, or improvements therein may be subsequently made by those skilled in the art which are also intended to be encompassed by the appended claims. Therefore, the spirit and scope of any appended claims should not be limited to the description of the embodiments contained herein.

What is claimed is:

1. An article configured to be worn or carried by a human, the article comprising:

a body portion comprised of a flexible material, the body portion defining an inside and an outside of the article, the inside of the article void of an air distributor;

an opening formed in the body portion, the opening providing a passage between the inside and the outside of the article;

a deodorant enclosure secured to the body portion at the opening, the deodorant enclosure including a chamber positioned between an inner wall and an outer wall, the deodorant enclosure configured to move between a closed position and an open position, the inner wall and the outer wall of the deodorant enclosure including a plurality of air passages that lead to the chamber, the inner wall of the deodorant enclosure attached to a frame member with a hinge structure, wherein the inner wall and the hinge structure move when the deodorant enclosure moves between the closed position and the open position; and a deodorant insert positioned within the chamber, wherein the deodorant insert is secured in the chamber when the deodorant enclosure is in the closed position, and wherein the deodorant insert is removable from the chamber when the deodorant enclosure is in the open position.

2. The article of claim 1 wherein the deodorant insert is removably retained within the chamber between the inner wall and the outer wall but is freely moveable between the inner wall and the outer wall.

3. The article of claim 2 wherein the deodorant insert comprises a solid deodorant substance.

4. The article of claim 2 wherein the deodorant insert comprises a deodorant cartridge comprising a liquid deodorant substance.

5. The article of claim 1 wherein the article is a garment or a bag.

6. The article of claim 1 wherein the deodorant insert includes a substance intended to control bacteria.

7. The article of claim 1 wherein the flexible material is a textile.

8. The article of claim 1 wherein the flexible material is a synthetic or natural leather material.

9. The deodorant device of claim 1 further comprising a handle positioned on the inner wall.

10. A deodorant device comprising:

a bag including a piece of textile defining a chamber void of an air distributor; an opening formed in the piece of textile, the opening defining a perimeter and a passage from a first side of the piece of textile to a second side of the piece textile;

a deodorant enclosure secured to the piece of textile and at least partially covering the opening, the deodorant enclosure including a chamber positioned between a first side of the deodorant enclosure and an opposing second side of the deodorant enclosure, both the first side and the second side of the deodorant enclosure permeable to air, the second side of the deodorant enclosure including a door connected to a frame member by a hinge, the frame member connected to the second side of the piece of textile around the perimeter of the opening, the door and the hinge moveable between a first position where the door substantially covers the opening and a second position where the door is removed from the opening; and a deodorant insert removably positioned in the chamber of the deodorant enclosure.

11. The deodorant device of claim 10 wherein the piece of textile is comprised of a first section joined to a second section with the opening formed between the first section and the second section.

12. The deodorant device of claim 10 wherein the piece of textile is provided on a garment.

13. The deodorant device of claim 10 wherein the door includes a grill portion.

14. The deodorant device of claim 10 wherein the second side of the deodorant enclosure is positioned within the carrying chamber.

15. The deodorant device of claim 14 further comprising a handle positioned on the door and extending away from the door into the carrying chamber.

* * * * *